US006840395B2

(12) United States Patent
Agarwal et al.

(10) Patent No.: US 6,840,395 B2
(45) Date of Patent: Jan. 11, 2005

(54) PACKAGE WITH INTEGRATED UTENSIL

(75) Inventors: Surendra Agarwal, Glenview, IL (US); Carolina Alejandra Castellanos, DeForest, WI (US); Neil Enciso, Chicago, IL (US); Kyle Robert Karsten, Sun Prairie, WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 10/372,906

(22) Filed: Feb. 24, 2003

(65) Prior Publication Data

US 2003/0141309 A1 Jul. 31, 2003

Related U.S. Application Data

(62) Division of application No. 09/728,595, filed on Dec. 1, 2000, now abandoned.

(51) Int. Cl.[7] ..... B65D 1/36; B65D 25/00

(52) U.S. Cl. ..... 220/556; 220/194.1; 220/735; 220/212

(58) Field of Search ..... 220/574.1, 556, 220/594.1, 735, 212

(56) References Cited

U.S. PATENT DOCUMENTS

| | | | |
|---|---|---|---|
| 1,514,379 | A | 11/1924 | Fleischer |
| 1,607,865 | A | 11/1926 | Betts |
| 1,848,066 | A | 3/1932 | Shepard et al. |
| 3,334,778 | A | 8/1967 | Saunders |
| 3,381,876 | A | 5/1968 | O'Brien |
| 3,511,433 | A | 5/1970 | Andrews et al. |
| 3,550,805 | A | 12/1970 | Leonforte |
| 3,624,787 | A | 11/1971 | Newman |
| 3,704,779 | A | 12/1972 | Ego Werke A G |
| 4,013,798 | A | 3/1977 | Goltsos |
| 4,060,176 | A | 11/1977 | Tobiasson |
| 4,067,475 | A | 1/1978 | Pinkau et al. |
| 4,216,875 | A | 8/1980 | Stanish |
| D324,651 | S | 3/1992 | Kaneko |
| 5,236,119 | A | 8/1993 | Chu |
| 5,251,774 | A | 10/1993 | Engle |
| 5,443,174 | A | 8/1995 | Bauer |
| D379,301 | S | 5/1997 | Lippincott |
| 5,727,679 | A | 3/1998 | Newarski |
| 5,747,084 | A | 5/1998 | Cochran et al. |
| D395,003 | S | 6/1998 | Daniels |
| D398,524 | S | 9/1998 | Waterhouse |
| D404,642 | S | 1/1999 | Major |
| 5,992,667 | A | 11/1999 | Huang |
| D417,785 | S | 12/1999 | Daniels |
| 6,003,710 | A | 12/1999 | Huang |
| D429,147 | S | 8/2000 | Baker et al. |
| D432,409 | S | 10/2000 | Feldmeier |
| D454,489 | S | 3/2002 | Enciso et al. |
| 6,371,324 | B1 | 4/2002 | Torniainen et al. |
| D456,707 | S | 5/2002 | Agarwal |
| 6,412,653 | B1 | 7/2002 | Waterhouse |

*Primary Examiner*—Joseph Man-Fu Moy
(74) *Attorney, Agent, or Firm*—Fitch, Even, Tabin & Flannery

(57) ABSTRACT

A food product container includes a molded tray having at least one cell for holding a food product. A removable cover, such as lidding film, seals the cell in preparation for shipment. A utensil, such as a spoon or knife or the like, is integrally molded with the container.

3 Claims, 9 Drawing Sheets

PACKAGE WITH INTEGRATED UTENSIL

This is a division, of prior application Ser. No. 09/728,595, filed Dec. 1, 2000, now abandoned which is hereby incorporated herein by reference in its entirety.

BACKGROUND OF THE INVENTION

1. Field of the Invention

The invention relates generally to packaging, and to the inclusion of eating utensils in food packaging. More particularly, the invention relates to a one piece assembly of a multi-compartment container and utensil for use therewith.

2. Description of the Related Art

With increasing popularity of ready-to-eat meals, various container arrangements have been proposed for transport and meal serving. Oftentimes, ready-to-eat meals are consumed either at locations of opportunity or locations remote from traditional kitchen or dining room environments. Accordingly, consideration must be given to providing eating utensils. While a separate package of eating utensils, such as a spoon, knife or spreading stick could be provided, it is desirable from a merchandising standpoint and from the standpoint of convenience to the consumer, that the utensil somehow be integrated with the food package.

In the past, numerous patents have disclosed containers intended to enable consumers to eat one or more food products directly from the container. Examples of prior art food product containers of this type are shown in U.S. Pat. No. Des. 393,798 and No. 5,277,920. The prior art also includes patents showing food product containers that include utensils such as spreading implements or spoons, either as separate articles inserted in the containers, or as integrally molded components of the lids. See, e.g., U.S. Pat. Nos. 6,003,710; No. 5,992,667; No. 5,727,679; No. 5,443,174; No. 5,251,774; No. 4,216,875; No. 4,060,176; No. 3,624,787; No. 3,550,805; and No. 3,334,778. Insertion of utensils as separate articles adds cost and can limit packaging line speeds. As mentioned in above-referenced U.S. Pat. No. 5,277,920, maintaining quality control with respect to insertion of utensils and proper placement thereof within a package may require costly interruptions of packaging operations to adjust insertion equipment. Also, after utensils have been placed in the package, they may be displaced during shipping and handling to undesirable locations within the package. Inclusion of the utensils as lid components may avoid these problems, but may also unacceptably increase the cost of some packages.

In providing a container for commercial packaging of food products, among the considerations that must be addressed are the ability of the container to be formed, filled and sealed economically in a high speed packaging line, the degree of difficulty that will be encountered by the consumer in opening and dispensing food product from the container, the ability of the container to withstand various loads, such as stacking loads, during filling, sealing, shipping, display and consumer use, and the ability of the container to be packed efficiently among like containers. Also, it is desirable that a container have ample label display area and an aesthetically pleasing appearance.

There is a need for improved food packages with included utensils, and for improved methods of incorporating utensils in food containers.

SUMMARY OF THE INVENTION

The invention provides an improved food product container comprising a tray including at least one cell for holding a food product wherein a spoon or other utensil is included in the tray, either as part of a flange or web, or as part of a compartment. A removable cover is provided to seal the cell. The removable cover may also provide a seal over the utensil.

It is an object of the present invention to provide a ready-to-eat meal kit including a multi-compartment container and an eating utensil integrally associated therewith.

Another object of the present invention is to provide a one-piece molded plastic assembly of a multi-compartment container and an eating utensil, such as a spoon.

A further object of the present invention is to provide a meal kit of the type described above which is made ready for closure with foil lidding material or the like, to prepare the meal kit for transport to a consumer.

These and other objects according to principles of the present invention are provided in [insert claim 1].

DETAILED DESCRIPTION OF THE PREFERRED EMBODIMENTS

Figure 1:
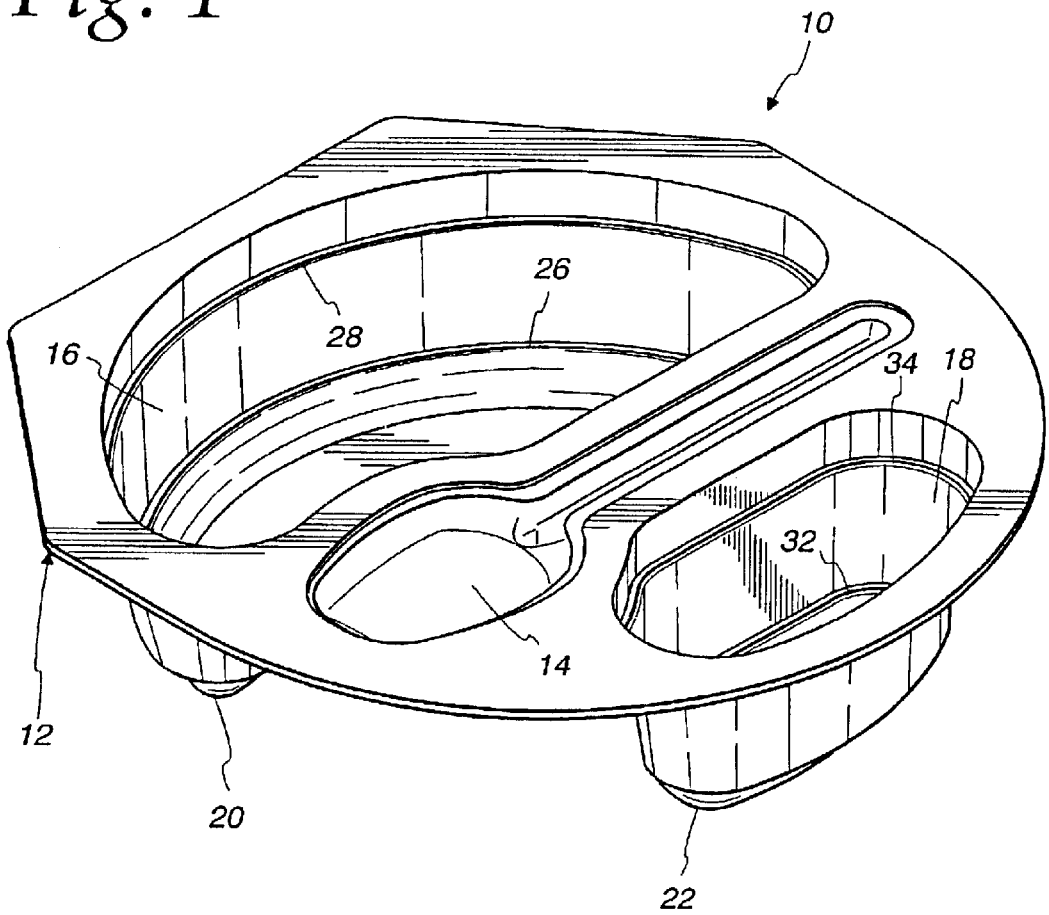
FIG. 1 is a perspective view of an alternative embodiment of a one piece assembly of a multi-compartment container and utensil.
Figure 2:
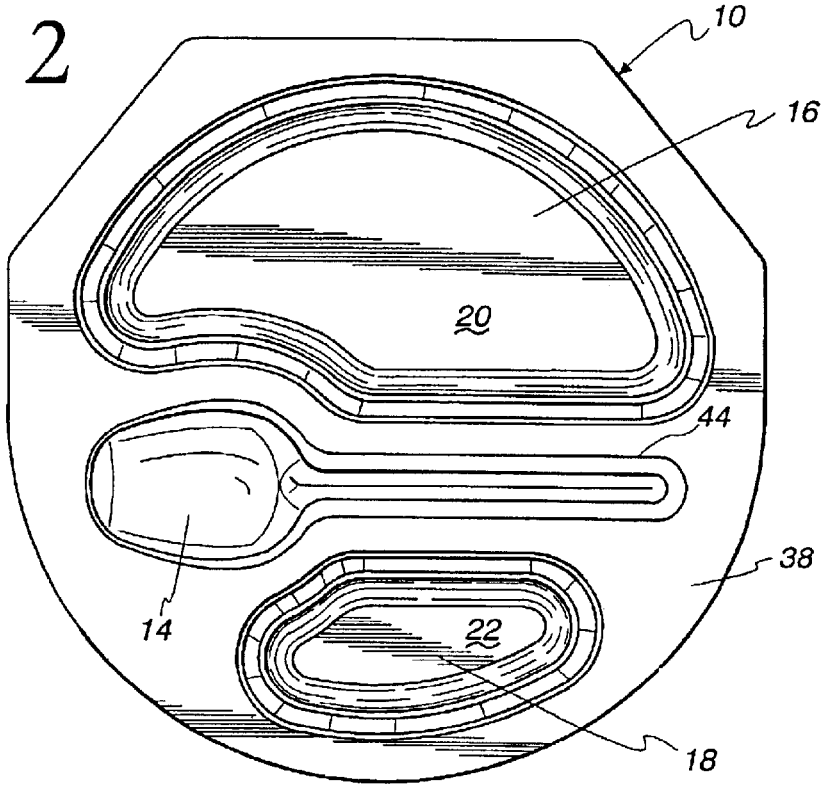
FIG. 2 is a top plan view thereof.
Figure 3:
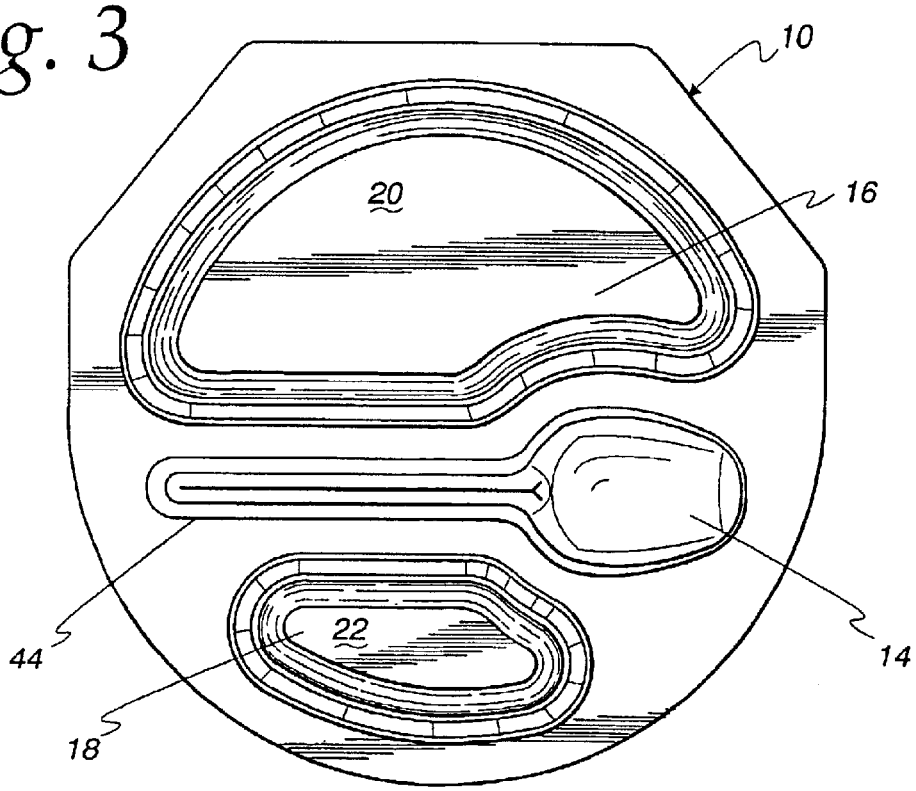
FIG. 3 is a bottom plan view thereof.
Figure 4:
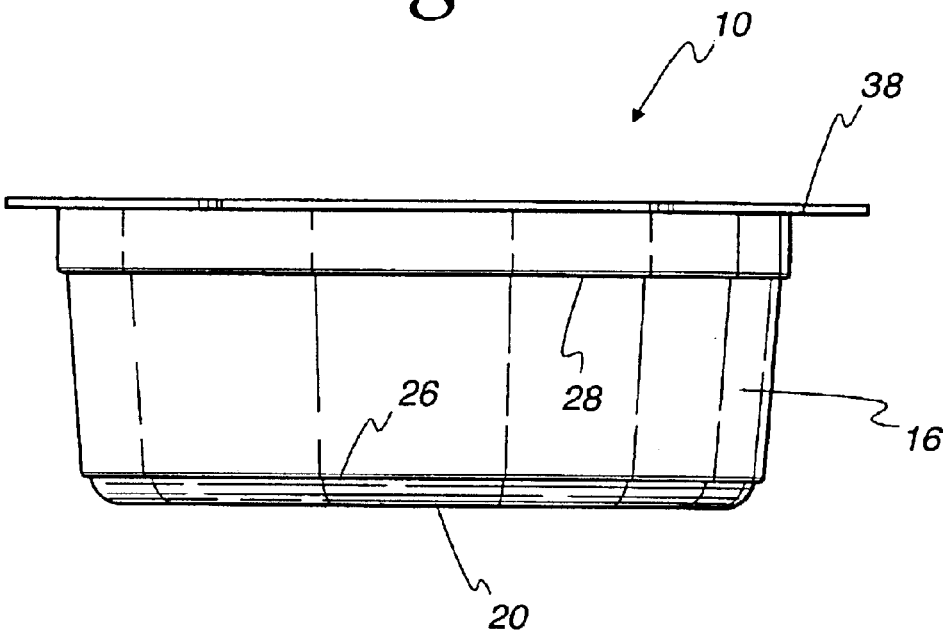
FIG. 4 is an elevational view taken from one side thereof.

Turning now to FIGS. 1–7, one-piece packaging or container arrangement for a meal kit or the like is generally indicated at 10. Packaging 10 comprises a one-piece structure, including a container portion generally indicated at 12 and a utensil portion indicated at 14. In the preferred embodiment, packaging 10 is formed in a single integral piece using conventional plastic thermoforming materials and techniques. Container portion 12 includes a larger cell or cavity 16 and a smaller cavity 18.

As shown, the bottom portions 20, 22 of cavities 16, 18 are tapered with a stepped configuration. Sidewalls of cavity 16 include stepped portions 26, 28 while cavity 18 includes stepped portions 32, 34. As shown for example in the top plan view of FIG. 2, the cavities 16, 18 are continuously inwardly tapered from their top to their bottom portions. A web in the form of an upper wall 38 surrounds the cavities 16, 18 and utensil 14 and holds these components together in a unitary fashion.

Upper wall 38 is preferably flat or planar throughout for ready closure using lidding material such as foil, adhered to the upper wall with a suitable pressure sensitive adhesive. Other methods of enclosing the upper surface of container arrangement 10 may be chosen, using conventional arrangements, and upper wall 38 need not be flat. In order to aid in the ready application of a lidding material (preferably in a rigid or flexible sheet form), utensil 14, although given a preferred three-dimensional shape, is recessed below wall 38.

As can be seen in the drawings, utensil 14 is positioned between the cavities 16, 18. As with other embodiments, it is generally preferred that the utensil, in addition to being recessed, is accompanied by a planar border surrounding the outline of the utensil. This is important, in part, to prevent interference with the lidding material. As mentioned above, the preferred lidding material, of whatever material composition is desired, is preferably provided in a sheet form. Even if the lidding material were made rigid, any surface irregularities permitted to surround the utensil may prevent an intimate securement of the lidding material to the container, and this in turn might compromise any hermetic sealing or the like needed to preserve food freshness.

Utensil 14 is secured to wall 38 with a line of weakness 44. With the lidding material removed, utensil 14 is easily removed from wall 38 with the application of light finger pressure. Although the figures depict the utensil in the form of a spoon, other conventional utensil shapes such as forks, knives and spreading sticks may be employed, as well.

Figure 15:
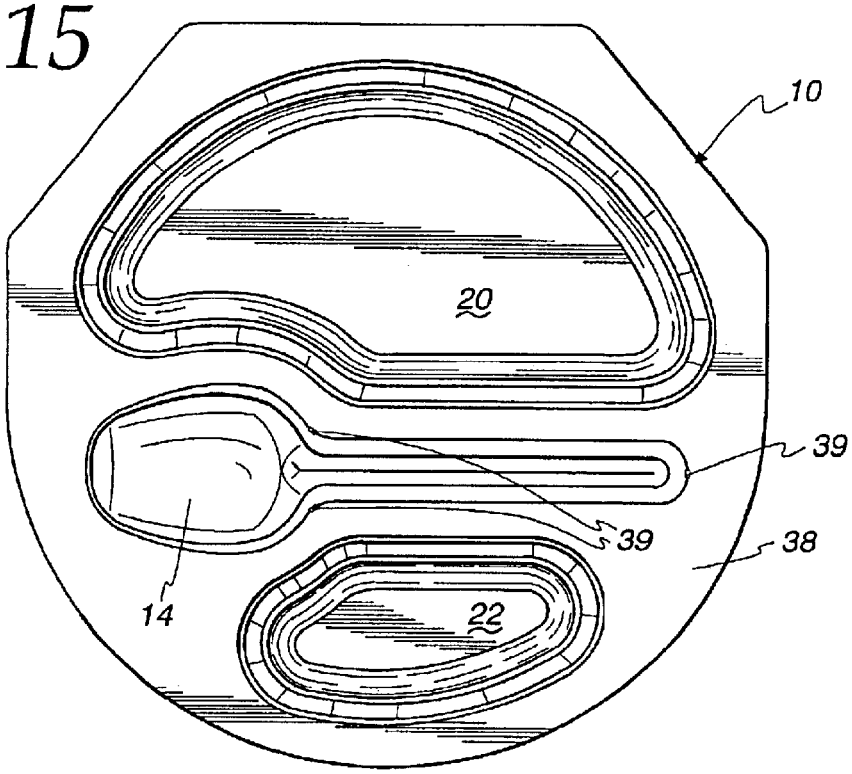
FIGS. 15 and 16 are top elevational views showing alternative methods of attaching a utensil to a container.
Figure 16:
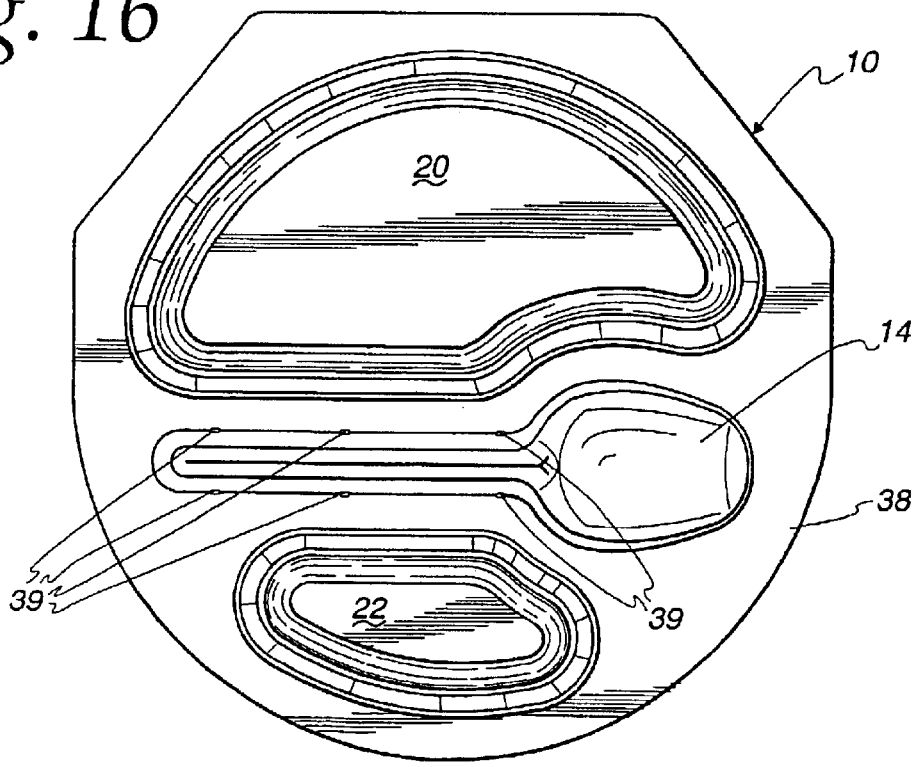

Referring to FIGS. 15 and 16, alternative methods of attaching utensil 14 to wall 38 are shown. FIGS. 15 and 16 show the preferred manner of attaching spoon-shaped utensils to portions of a planar wall located alongside one or more container cavities. In FIG. 15, utensil 14 is defined by a line of weakness comprising an outline indentation which either cuts through the full thickness of wall 38 or is cut so deep as to render the resulting attachment of the utensil negligible. In order to reliably secure the utensil 14 to the wall 38 during filling, sealing and subsequent operations, three points of securement 39 join the outer margin of the utensil to the wall 38. As mentioned, utensil 14 of the preferred embodiment comprises a spoon and it has been found convenient in this regard to locate three points of attachment as indicated in FIG. 15. Preferably, the points of attachment 39 comprise bridging of plastic material between the utensil margin and the wall 39. Most preferably, the bridging is formed by substantially completely severing margin portions of utensil 14 between the attachment points 39. Preferably, connection points 39 comprise frangible bridges. Other conventional bridging arrangements and methods of attaching the utensil to the wall can be employed, if desired. It is generally preferred that the utensil and the wall, as with remaining portions of container 10, be formed from a single plastic sheet using conventional forming techniques.

Referring now to FIG. 16, utensil 14 is joined to wall 38 by six points of attachment indicated by numeral 39. In FIG. 16, the points of attachment are restricted to mid-portions of the spoon handle, whereas in FIG. 15 the points of attachment are located at the ends of the spoon handle. In both FIGS. 15 and 16, the hollow depression of the spoon is free of connection points 39 although one or more connection points could be added to this portion of the utensil, if desired. As a further alternative, the connection points 39 could comprise a heavier, more substantial joinder of the utensil to the container wall and the remaining outer margins of the utensil could be joined to the container wall with a line of weakness. Such an arrangement may be desirable where the plastic sheet material employed is relatively thin, for example.

As mentioned above, it is preferred that the utensil be formed from the same stock material as wall 38 and the cavity portions. Two methods are generally preferred for forming the utensil in this manner. In a first method, the container arrangement 10 is formed and subsequently transferred to a secondary station where the outline of the utensil is defined by a metal punch which forms a line of weakness. In this method, delivery time to the secondary station results in the container arrangement being sufficiently cooled, such that punching is performed on a cooled and hardened workpiece. It is most preferred that the material for the metal punch be chosen to be hard enough to define the line of weakness, but yet soft enough to prevent resulting sharp edges in the utensil, once it is withdrawn from the container arrangement. In a second method, the container arrangement is operated on by a metal punch at the forming station. Accordingly, in the latter method, the metal punching is performed on warm, soft plastic which, after cooling, results in a separation edge of the utensil which is smoother to the touch.

Figure 5:
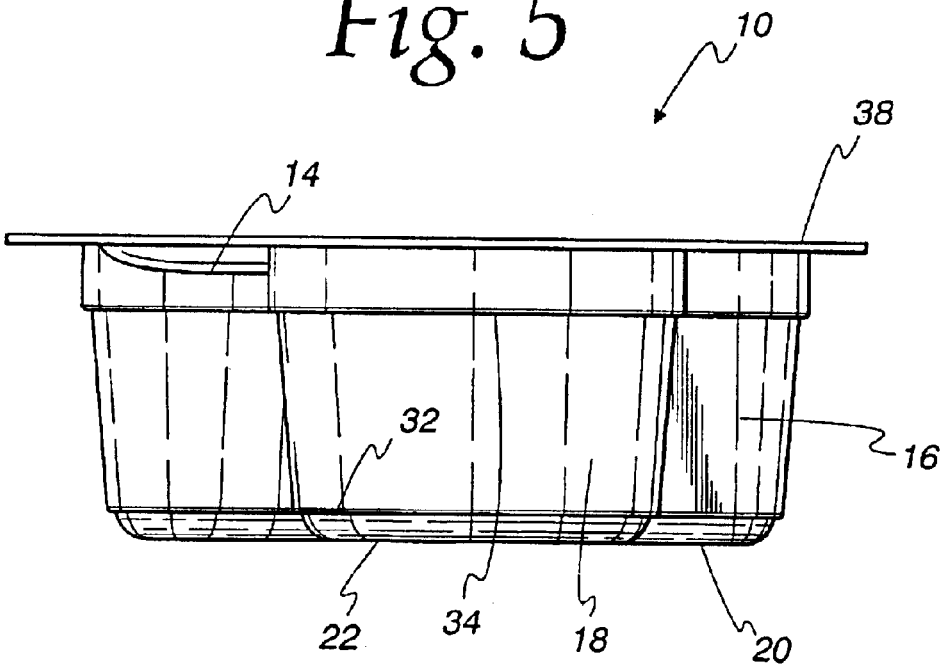
FIG. 5 is an elevational view taken from the other side thereof.
Figure 6:
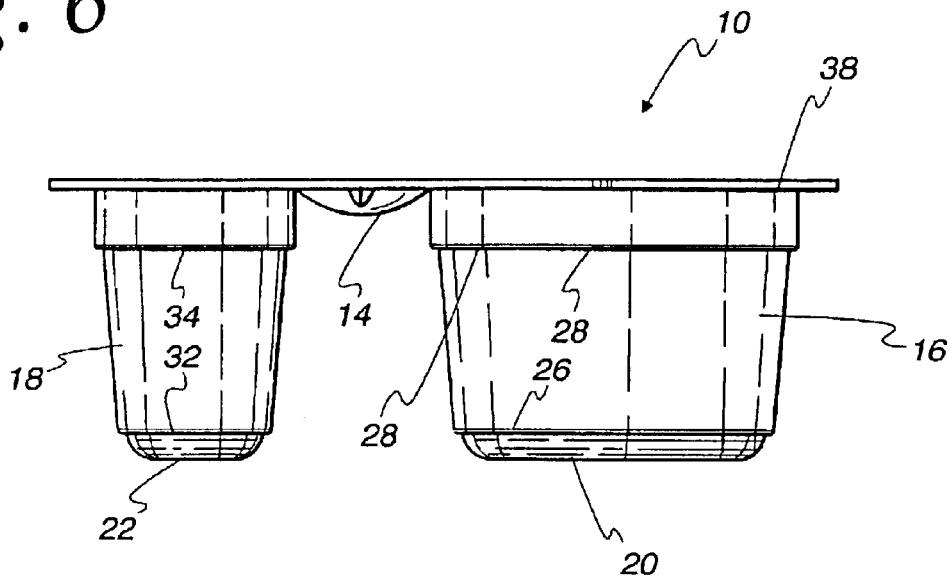
FIG. 6 is a rear elevational view thereof.
Figure 7:
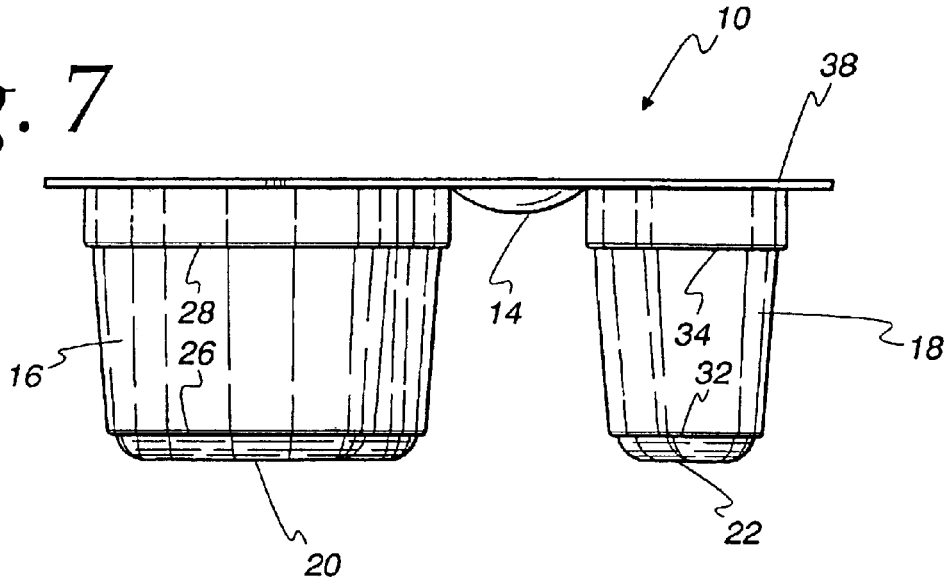
FIG. 7 is a front elevational view thereof.

Turning now to FIGS. 5–7, it can be seen that the bottom surface of utensil 14 is "nested" between the bottom portions 20, 22 of cavities 16, 18. As can be seen, the cavities have a depth much greater than that of utensil 15. As a result, utensil 15 is shielded from inadvertent contact, reducing or eliminating the need for additional shielding protection on the underside of the container arrangement.

Figure 8:
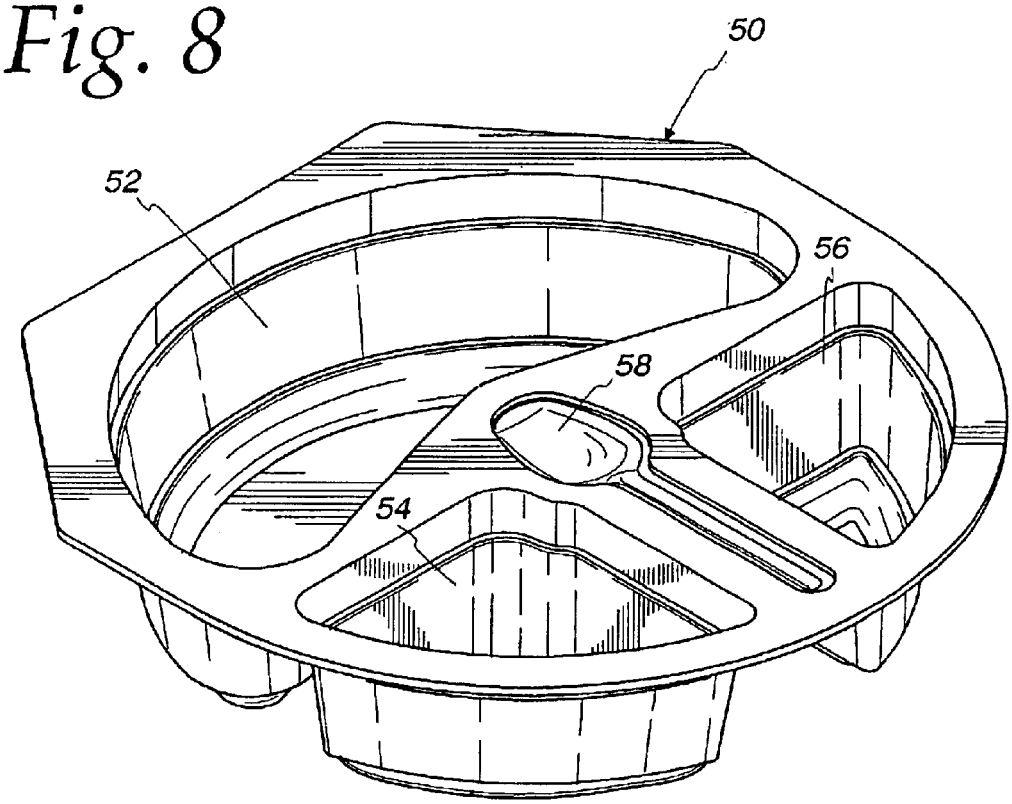
FIGS. 8–12 are perspective views showing alternative embodiments according to principles of the present invention.

FIG. 8 shows an alternative packaging embodiment generally indicated at 50. Packaging 50 is substantially identical to container arrangement 10, described above, except for the inclusion of three cavities 52–56. As with the preceding embodiment, packaging 50 includes a utensil 58, preferably located, at least partly, between the three adjacent cavities. As will be seen below, the utensil could also be formed to one side of the cavities.

Figure 9:
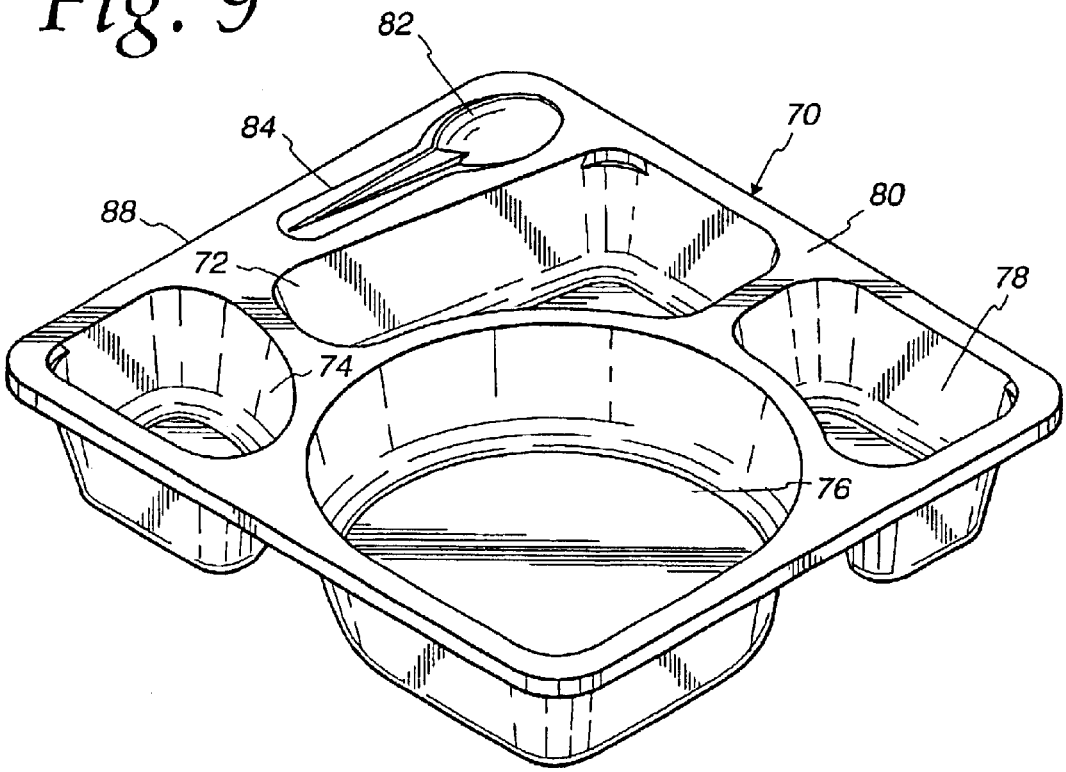

Referring now to FIG. 9, a further alternative packaging embodiment is generally indicted at 70. Included in the packaging are four cavities 72–78 surrounded by an upper wall 80. A utensil 82 includes an outer line of weakness 84 formed in upper wall 80. In the illustrated assembly, utensil 82 is located to one side of cavity 72, adjacent the outer periphery 88 of upper wall 80. As with the other embodiments, it is generally preferred that utensil 82 be formed in a manner recessed from upper wall 80 and be surrounded by a flat, planar border portion.

Figure 10:
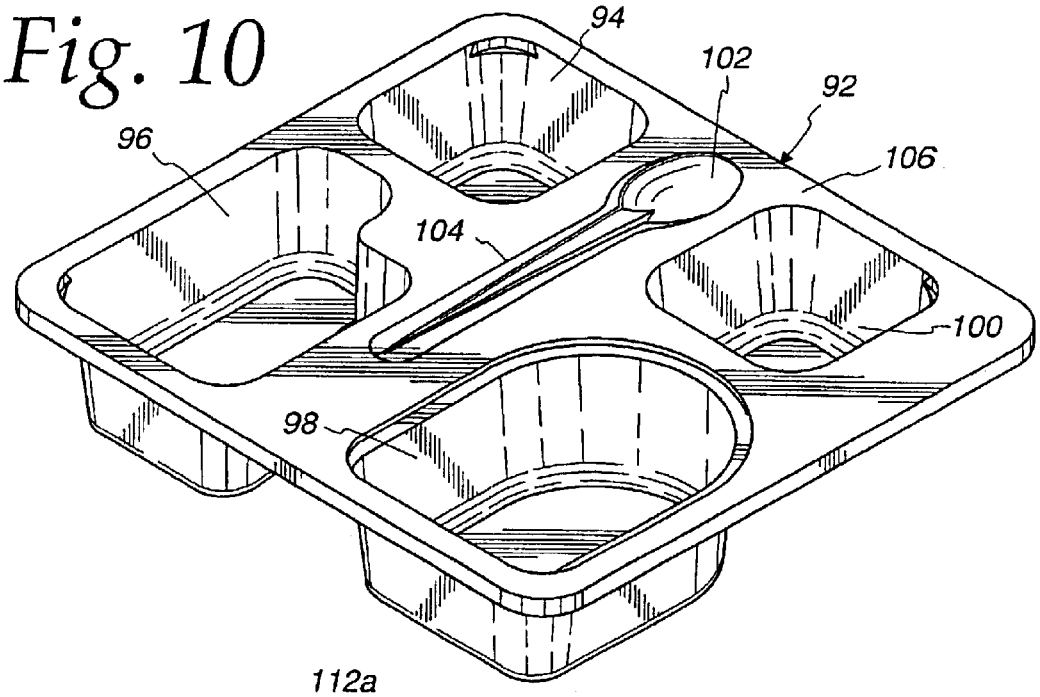

Referring now to FIG. 10, packaging 92 includes cavities 94–100. A utensil 102 includes an outer line of weakness 104 formed in an upper wall 106. Utensil 102 spans multiple adjacent cavities located on each side of the utensil. However, it is generally preferred that the utensil be surrounded by a generally flat, planar border portion, most preferably comprising a part of upper wall 105 extending throughout the container top. Utensil 102 is preferably recessed so as to be compatible with lidding materials spanning the top of the packaging.

Figure 11:
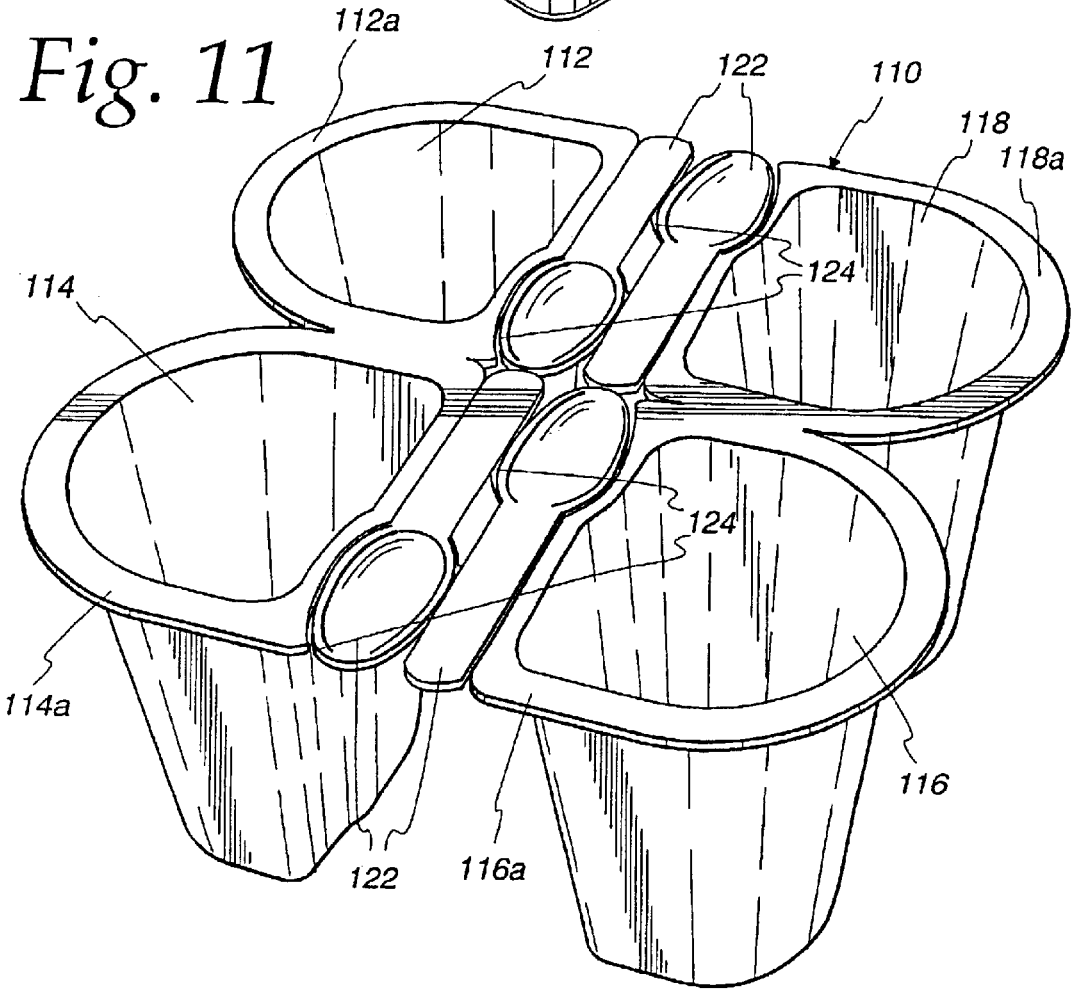

Turning now to FIG. 11, packaging 110 defines four cavities 112–118. The cavities 112–118 are surrounded by upper wall portions 112*a*–118*a*, respectively. Preferably, the upper wall portions 112*a*–118*a* are coplanar to accommodate the ready application of a continuous sheet of lidding material, such as foil. As shown in FIG. 11, the cavities 112–118 are arranged in two pairs, separated by a joined plurality of utensils 122. Together, the cavities 112–118 and their surrounding top wall portions 112*a*–118*a* comprise respective cup portions. Preferably, adjacent cup portions are separable one from another by lines of weakness (not visible in the figure) so as to be divided from the assembly 110, as desired.

As in the preceding embodiments, it is generally preferred that the utensils 122 extend below the plane of the top wall portions 112*a*–118*a*. It is generally preferred that the utensils be at least partly surrounded by generally flat, planar border portions. As can be seen in FIG. 11, the generally flat handle portion of one utensil serves as a surrounding border portion for the laterally adjacent utensil. Most preferably, the rounded end portions of the utensils also include relatively flat utensil border portions 124 which preferably are disposed co-planar with the top wall.

The utensils 122 are preferably joined together along lines of weakness with the joinder being strengthened by the application of a continuous sheet of lidding material extending across the entire top of container 110. Upon arrival at the consumer, after the lidding material is removed, the pairs of cup portions on either side of utensils 122 are separated and the utensils removed. Thereafter, the pairs of cup portions can be "folded" which will cause propagation of a separation line between the cup portions, facilitating their division for separate movement.

If desired, the lidding material can be weakened in accordance with the cup portion to which it is secured. Accordingly, unused cup portions can remain sealed by portions of the lidding material. As shown in FIG. 11, it is generally preferred that the several utensils 122 be associated with respective cup portions. The lidding material can be weakened so as to join the utensils with respective cup portion.

Figure 12:
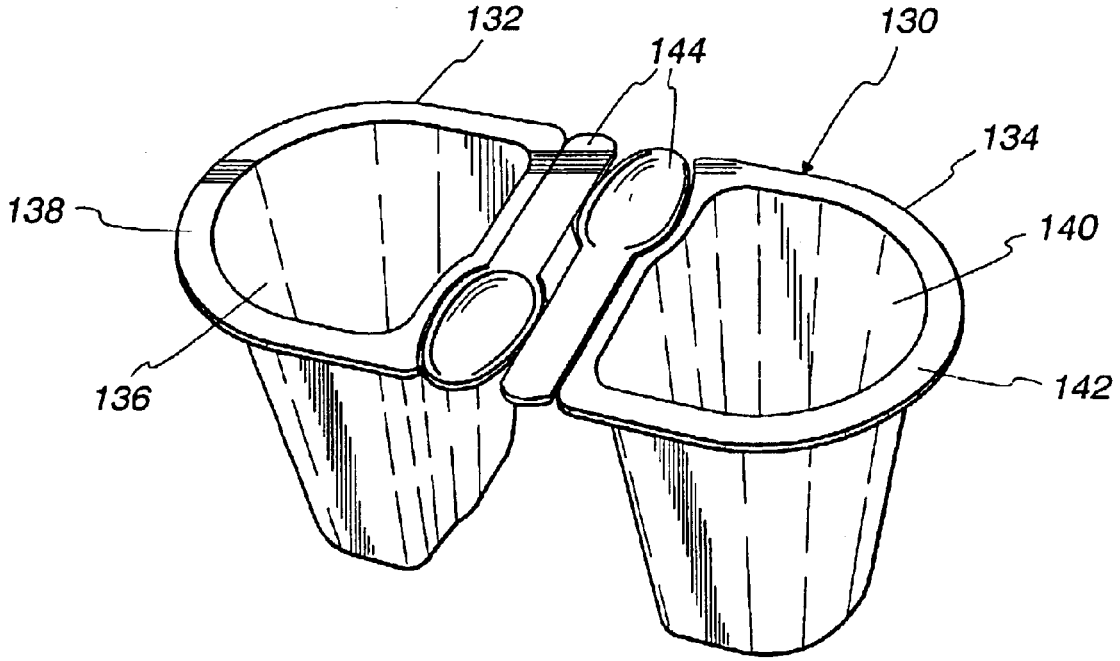

Referring now to FIG. 12, packaging generally indicated at 130 is provided with two cup portions 132, 134. Cup portion 132 includes a cavity portion 136 and an outer surrounding top wall portion 138. Cup portion 134 similarly includes a cavity portion 140 and a surrounding top wall portion 142. A pair of utensils 144 are located between the cup portions and, as in the preceding embodiments, project below a planar alignment of top wall portions 138, 142. As can be seen by comparing FIGS. 11 and 12, packaging 130 comprises a one-half portion of packaging 110.

Figure 13:
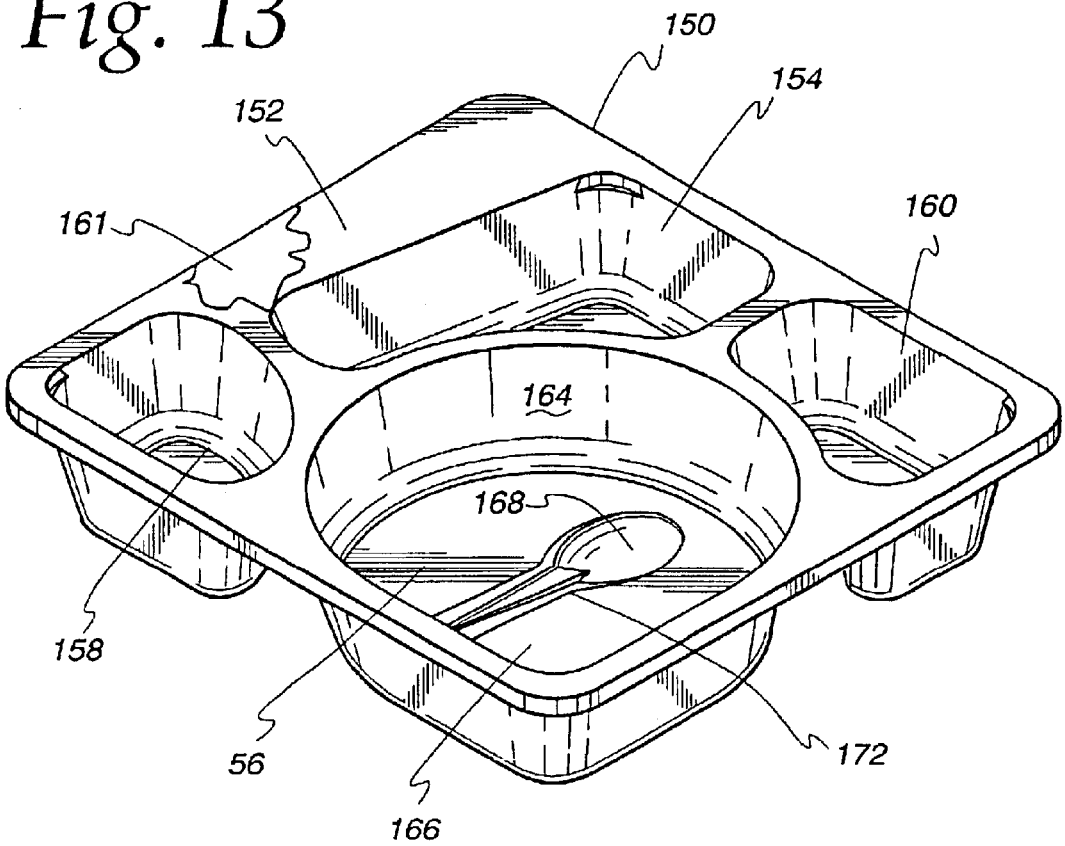
FIGS. 13 and 14 are side elevational views showing further alternative embodiments according to principles of the present invention.

As can be seen from the above, the various utensils have been associated with the top wall of the packaging. At times, it may be more convenient to locate the utensil on a different part of the packaging, such as a bottom wall or a side wall. Turning now to FIG. 13, packaging 150 includes a top wall 152 and four downwardly extending cavities 154–160. Cavity 156 includes a sidewall 164 and a bottom wall 166. A utensil 168 is formed in bottom wall 166 by an intervening line of weakness 172. The utensil 168 can protrude inwardly into cavity 164 or downwardly below bottom wall 166, or both, as may be desired. For example, when it is desired to have the packaging 150 present a flat, planar (discontinuous) bottom surface for stacking or other reasons, utensil 168 can be formed up-side-down with respect to the preceding embodiments so as to project into cavity 164, without projecting beyond bottom wall 166. If desired, a sheet of material, such as that used for lidding, can be positioned so as to cover bottom wall 166 so as to secure the utensil in position, preventing unintentional dislocation during shipping. As mentioned, utensil 168 is joined to bottom wall 166 by a line of weakness. When hermetic sealing of 164 is required, a lidding or other barrier material adhesively secured to the underside of bottom wall 166 (at least in the area of utensil 168) can be employed to ensure hermetic sealing in cooperation with lidding material secured to top wall 152. If desired, utensil 168 formed in bottom wall 166 can be supplemented by additional utensils formed in upper wall 152 or in other portions of the packaging.

Figure 14:
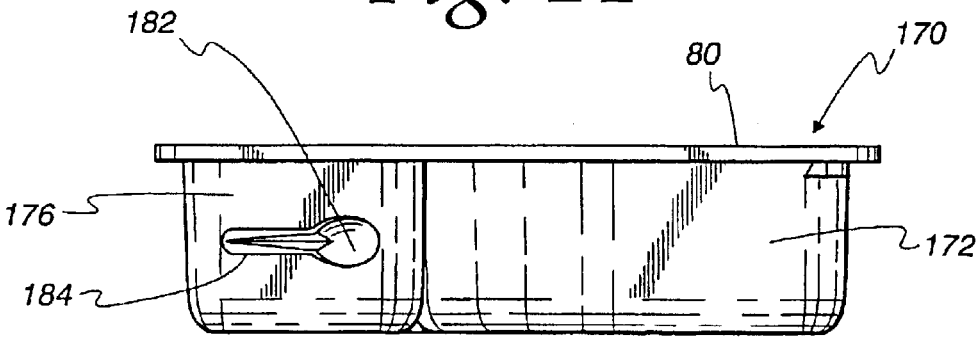

Turning now to FIG. 14, packaging 170 generally resembles packaging 70 described above with reference to FIG. 9. Package 170 includes a sidewall 172 partly defining cavity 76 (see FIG. 9). Sidewall 176 partly defines cavity 74 (see FIG. 9). The sidewalls 172, 176 are suspended form top wall 80. Packaging 170 further includes a utensil 182 joined to sidewall 176 by a line of weakness 184. Sidewall 176 is generally flat and it is preferred that utensil 182 have an outer marginal portion generally co-extensive with sidewall 176 and with an interior portion recessed with respect to the outer surface of sidewall 176, so as to project into cavity 74. If it is desirable to maintain the interior surface of the cavity sidewalls in a flat condition, utensil 182 can be recessed with respect to the sidewall interior surface. Although the utensil has been described with reference to a generally flat sidewall, the utensil could be formed from a curved sidewall or corner of a cavity, so as to take on a rounded shape.

It will now be appreciated that the present invention provides practical commercial advantages in the field of forming, filling and sealing commercial food packaging units, especially those of the type described above. The packaging units are preferably fabricated using conventional vacuum forming techniques to include one or more of the various features described above, as may be desired. Generally speaking, the packaging will include at least one cell or cavity for receiving a food product, surrounded by a top wall. At least one eating utensil, such as a spoon or other eating implement, is integrally formed as a portion of the packaging unit, and is preferably a surrounded with a line of weakness, allowing the eating utensil to be easily removed from the packaging unit. The cell is then filled with a food product and the cell is covered over with a flexible web, such as a sheet of lidding material. As mentioned above, a packaging unit may be provided with several cells, and the cells may be non-identical so as to accommodate a variety of different types and shapes of food products. It is a generally preferred in this instance, that all of the cells be covered with a common flexible web.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by one or more of the following claims.

What is claimed is:

1. A food product container comprising:

a tray including at least two spaced apart cells, with one cell for holding a food product;

a removable cover for sealing said cells prior to use;

a continuous undivided wall between said cells and surrounding said cells, to engage said cover, said wall having an unsupported free edge;

said tray including at least one eating utensil integrally formed with said wall, between said cells, said eating utensil comprising a one-piece spoon having a bowl portion and an elongated handle portion having a first end joined to said bowl portion and a second free end and at least three spaced-apart joining members joining only said handle portion to said wall, with one joining member at or adjacent one end of said handle portion, and with said bowl portion being entirely unconnected to said wall; and said cells each having adjacent concave and convex curved parts conformed to said bowl portion partially surrounding said bowl portion to stiffen said wall on both sides of said bowl portion in proximity there to.

2. The container of claim 1 wherein one of said joining members is located at the free end of said handle portion.

3. The arrangement of claim 1 wherein six joining members are provided, spaced along the length of said handle portion.

* * * * *